US011447846B2

(12) United States Patent
Pan et al.

(10) Patent No.: US 11,447,846 B2
(45) Date of Patent: Sep. 20, 2022

(54) COMPREHENSIVE RECOVERY METHOD OF PYROLYSIS POLYMETALLIC PRODUCT FROM WASTE INTEGRATED CIRCUIT BOARD

(71) Applicant: Beijing University of Technology, Beijing (CN)

(72) Inventors: Dean Pan, Beijing (CN); Yufeng Wu, Beijing (CN); Bin Li, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 0 days.

(21) Appl. No.: 17/609,277

(22) PCT Filed: Jul. 17, 2019

(86) PCT No.: PCT/CN2019/096265
§ 371 (c)(1),
(2) Date: Nov. 5, 2021

(87) PCT Pub. No.: WO2020/224053
PCT Pub. Date: Nov. 12, 2020

(65) Prior Publication Data

US 2022/0205063 A1 Jun. 30, 2022

(30) Foreign Application Priority Data

May 7, 2019 (CN) ..... 201910376417.0

(51) Int. Cl.
*C22B 3/00* (2006.01)
*C22B 15/00* (2006.01)
(Continued)

(52) U.S. Cl.
CPC ..... *C22B 23/043* (2013.01); *C22B 7/001* (2013.01); *C22B 7/007* (2013.01); *C22B 11/025* (2013.01);
(Continued)

(58) Field of Classification Search
CPC ..... C22B 23/043; C22B 7/007; C22B 11/025; C22B 11/046; C22B 15/0028; C22B 15/0071; C22B 23/02
(Continued)

(56) References Cited

FOREIGN PATENT DOCUMENTS

| | | |
|---|---|---|
| CN | 1172167 | 1/2000 |
| CN | 102534226 | 7/2012 |

(Continued)

OTHER PUBLICATIONS

CN1172167A Translation (Year: 1998).*

*Primary Examiner* — Brian D Walck
*Assistant Examiner* — Danielle M. Carda
(74) *Attorney, Agent, or Firm* — Leonid Kisselev

(57) ABSTRACT

The invention relates to a method for multi-metal products recovery from pyrolytic waste integrated circuit boards. The method mainly comprises the steps of smelting and blending, atomization, acidolysis and filtration, noble metal recycling, copper extraction and back extraction, nickel extraction and back extraction. Compared with the prior art, the method has the advantages that smoke pollution and the smelting slag treatment in the process of preparing a black copper ingot through multi-metal collaborative smelting are reduced, and the problems of low anode efficiency of the black copper electrolysis process are solved. Meanwhile, the high-temperature high-oxygen atomized gas generated in the atomizing process provides a heat source and an oxygen source for subsequent acidolysis, so that the energy consumption is further reduced. The method has the advantages such as short process, remarkable energy conservation and emission reduction.

1 Claim, 2 Drawing Sheets

(51) Int. Cl.

| | |
|---|---|
| ***C22B 11/00*** | (2006.01) |
| ***C22B 7/00*** | (2006.01) |
| ***C22B 23/02*** | (2006.01) |
| ***C22B 11/02*** | (2006.01) |

(52) U.S. Cl.
CPC ..... *C22B 11/046* (2013.01); *C22B 15/0028* (2013.01); *C22B 15/0071* (2013.01); *C22B 23/02* (2013.01)

(58) Field of Classification Search
USPC ..... 75/419
See application file for complete search history.

(56) References Cited

FOREIGN PATENT DOCUMENTS

| | | |
|---|---|---|
| CN | 104046776 | 9/2014 |
| CN | 110004299 | 7/2019 |

* cited by examiner

COMPREHENSIVE RECOVERY METHOD OF PYROLYSIS POLYMETALLIC PRODUCT FROM WASTE INTEGRATED CIRCUIT BOARD

CROSS-REFERENCE TO RELATED APPLICATIONS

This patent application is the U.S. National Phase patent application under 35 U.S.C. § 371, which claims priority to International Application No. PCT/CN2019/096265, filed on Jul. 17, 2019, pending, which in turn claims the benefit of priority to Chinese Patent Application No. 201910376417.0, filed on May 7, 2019, pending, the disclosures of which are incorporated by reference herein.

TECHNICAL FIELD

The present invention relates to a multi-metal products recovery technology from pyrolytic waste integrated circuit boards, in particular to the use of melting and blending, atomization, acidolysis and other technologies to recover multi-metal materials obtained from pyrolytic waste integrated circuit boards and use the heat and oxygen of the atomization process.

BACKGROUND

Integrated circuit boards are an important part of electronic products and the foundation of modern electronic industries. Integrated circuit boards are mainly copper clad laminates composed of electronic components, glass fiber reinforced epoxy resin and many metal materials including precious metals. According to statistics, every ton of circuit board (WPCB) contains 50-400 kg copper, 1-40 kg nickel, 0.1-1 kg silver, 50-2000 g gold, and also contains valuable metals such as lead and tin. For different purposes of integrated circuit board, its content varies greatly. At the same time, the composition of WPCB is complex, such as heavy metals, brominated flame retardants and other harmful substances. Traditional recycling methods such as landfill and incineration will seriously damage the ecosystem.

In order to solve the problem of calorific value utilization of organic matter, crushing and sorting. CN108160665A proposes a carbonization cracking technology to realize the cracking and carbonization of circuit board organic matter, and convert organic matter such as carbon and hydrogen into fuel-based carbonized cracked oil and carbonized cracking after combustion, it provides a heat source to realize self-heating carbonization and cracking. The carbonized materials are easily broken and sorted due to the cracking of organic matter to obtain multi-metallic products. The multi-metallic product obtained by pyrolysis has a metal content of more than 90%, but a copper content of only 60%. It also contains impurity elements such as lead and tin, and precious metals such as gold and silver. Traditional multi-metal products mostly use collaborative smelting methods to smelt multi-metal products and copper-containing sludge and other waste materials to obtain black copper ingots and copper smelting slag. After black copper is pyro-refined, anode copper electrolysis is used to obtain electrolytic copper and copper anode slime, then anode slime is used for precious metal recovery. This method has the problems of long process, high loss of copper and rare metals and large energy consumption. In some electrolysis companies, black copper is used for direct electrolysis, but black copper has some problems such as low grade, low anode efficiency, high energy consumption and long electrolysis time. In order to solve the problems of long process and high energy consumption, the present invention proposes a recovery process that adopts direct smelting of multi-metal products, water and oxygen atomization, acidolysis, extraction and back extraction to recover copper and nickel. The acidolysis slag is used for recovering precious metals. Because this process only uses direct smelting, it avoids subsequent fire refining and wet refining processes. At the same time, the high-temperature and high-oxygen atomized gas provides stirring, heating and supplementary oxygen for acidolysis filtration process, which has a good energy-saving effect.

SUMMARY

The purpose of the present invention is mainly to solve the problem of separating copper and nickel through the atomization and acidolysis process of the multi-metal product obtained by the pyrolysis of waste integrated circuit boards, enriching and comprehensively recovering the precious metals. At the same time, the atomization gas generated during the atomization process provides heat source and oxygen for acidolysis, which has the advantages of short process and low energy consumption.

A method for multi-metal products recovery from pyrolytic waste integrated circuit boards comprises the following steps:

(1) melting and blending: adding multi-metals obtained by pyrolysis of waste integrated circuit boards into a smelting furnace, and adding a covering agent for smelting and blending under 1200-1350° C. with 0.5-1 hour to obtain an alloy solution; the covering agent adopts reducing substances such as carbon powder and coal powder, and the amount of covering agent added is 5-15% of the mass of multi-metal;

(2) atomization: atomize the alloy solution obtained in step (1) to obtain atomized powder and atomized gas;

(3) acidolysis and filtration: the atomized powder obtained in step (2) is immersed in an acidolysis solution for acidolysis, the acidolysis solution and acidolysis slag are obtained by filtration, and the acidolysis slag is preciously recovered to obtain rare and precious metals;

(4) copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration process as a supplementary solution of acidolysis solution; during the atomization process, the atomization water pressure is 10-15 MPa, the oxygen pressure is 1-1.2 MPa, and the nozzle aperture is 2-3 mm;

Further, during the acidolysis and filtration process, 150-200 kg/m$^3$ sulfuric acid is used as acidolysis solution, the solution-solid ratio is 10 L:1 kg-15 L:1 kg, the atomization gas is stirred with a flow rate of 1-300 L/min per liter acidolysis solution, acidolysis process adopts 98 mass percent industrial concentrated sulfuric acid for acidity adjustment, the acidolysis time is 1-3 hours, the pH at the end of the reaction is 3-4.

Compared with the prior art, the smoke pollution and smelting slag disposal in the process of preparing black copper ingots by synergistic smelting of multi-metal products are reduced, and the problems of low anode efficiency, long electrolysis time, and high consumption of black copper electrolysis process are solved. At the same time, the high-temperature and high-oxygen atomized gas generated during the atomization process provides a heat source and an oxygen source for subsequent acidolysis, further reducing the energy consumption.

The invention has the characteristics of low energy consumption, low emission, and short process.

PREFERRED EMBODIMENTS

Figure 1:
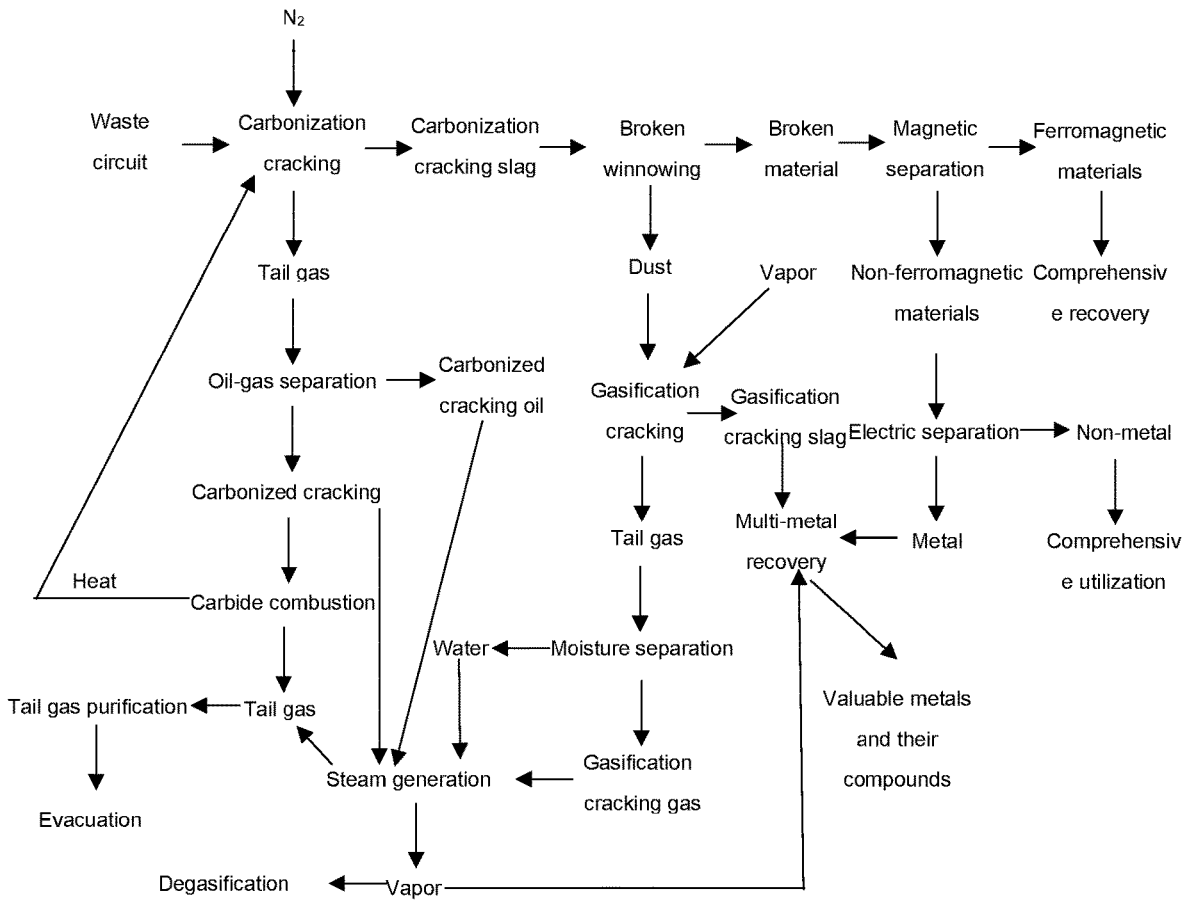
FIG. 1 shows the flow chart of multi-metal products obtained from pyrolytic waste integrated circuit boards
Figure 2:
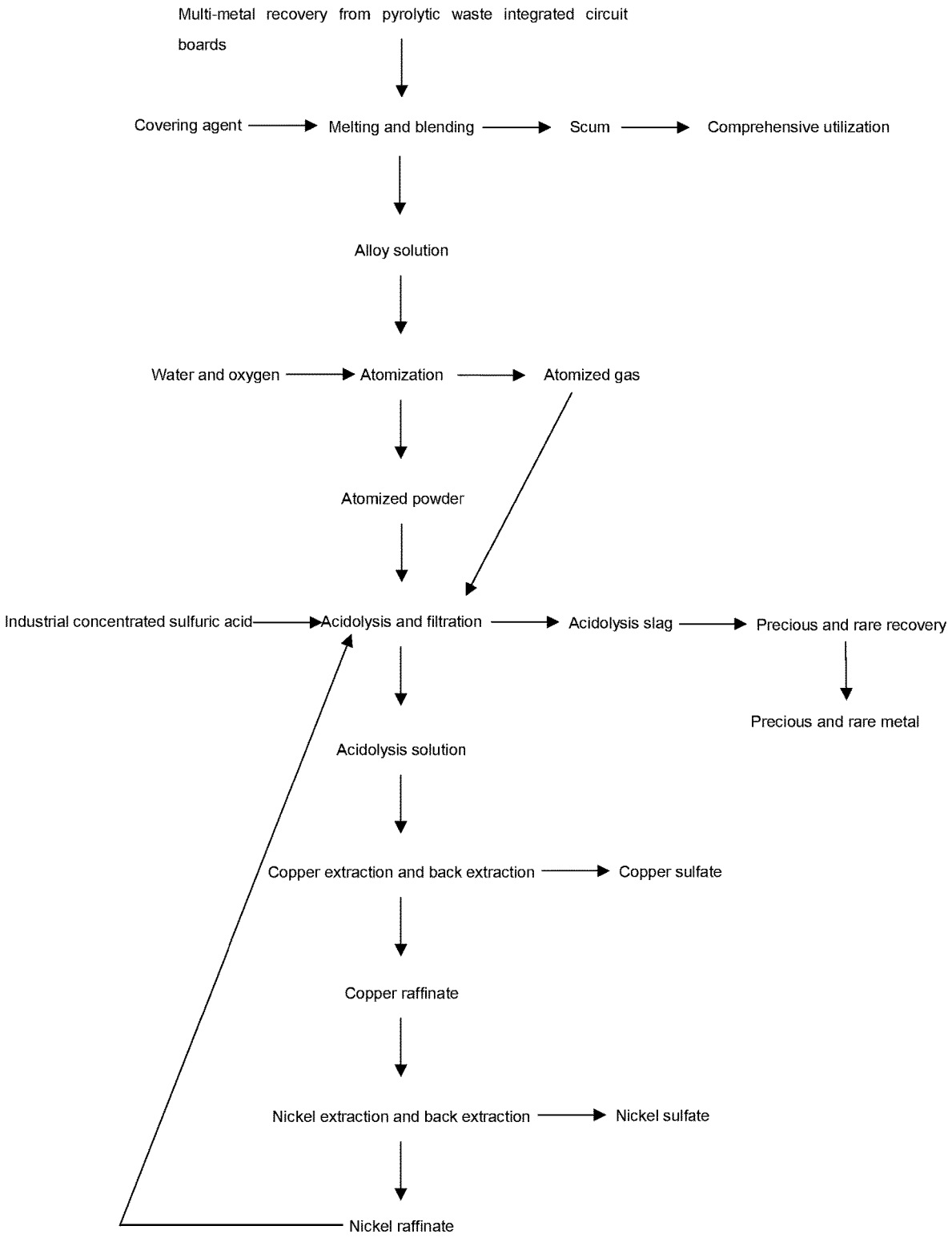
FIG. 2 shows a flow chart of a method for multi-metal products recovery from pyrolytic waste integrated circuit boards

The raw materials of multi-metal products used for comprehensive recovery in the embodiments are all obtained by using the method of CN108160665A.

Embodiment 1

Follow the steps below to recover:

(1) Melting and blending: adding multi-metals obtained by pyrolysis of waste integrated circuit boards into a smelting furnace, and adding a covering agent for smelting and blending under 1200° C. with 0.5 hour to obtain an alloy solution; adopts carbon powder or coal powder as the covering agent, and the amount of covering agent added is 5% of the mass of multi-metal.

(2) Atomization: atomize the alloy solution obtained in step (1) to obtain atomized powder and atomized gas; the atomization water pressure is 10 MPa, the oxygen pressure is 1 MPa, and the nozzle aperture is 2 mm.

(3) Acidolysis and filtration: the atomized powder obtained in step (2) is immersed in an acidolysis solution for acidolysis, the acidolysis solution and acidolysis slag are obtained by filtration, and the acidolysis slag is preciously recovered to obtain rare and precious metals; during the acidolysis and filtration process, 150 kg/m$^3$ sulfuric acid is used as acidolysis solution, the solution-solid ratio is 10 L:1 kg, the atomization gas is stirred with a flow rate of 1 L/min per liter acidolysis solution, acidolysis process adopts 98 mass percent industrial concentrated sulfuric acid for acidity adjustment, the acidolysis time is 1 hour, the pH at the end of the reaction is 3.

(4) Copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration process as a supplementary solution of acidolysis solution. The copper recovery rate is 99.3%, the nickel recovery rate is 99.2%, and the precious metal recovery rate is 98.5%.

Embodiment 2

Follow the steps below to recover:

(1) Melting and blending: adding multi-metals obtained by pyrolysis of waste integrated circuit boards into a smelting furnace, and adding a covering agent for smelting and blending under 1350° C. with 1 hour to obtain an alloy solution; adopts carbon powder or coal powder as the covering agent, and the amount of covering agent added is 15% of the mass of multi-metal.

(2) Atomization: atomize the alloy solution obtained in step (1) to obtain atomized powder and atomized gas; the atomization water pressure is 15 MPa, the oxygen pressure is 1.2 MPa, and the nozzle aperture is 3 mm.

(3) Acidolysis and filtration: the atomized powder obtained in step (2) is immersed in an acidolysis solution for acidolysis, the acidolysis solution and acidolysis slag are obtained by filtration, and the acidolysis slag is preciously recovered to obtain rare and precious metals; during the acidolysis and filtration process, 150 kg/m$^3$ sulfuric acid is used as acidolysis solution, the solution-solid ratio is 15 L:1 kg, the atomization gas is stirred with a flow rate of 300 L/min per liter acidolysis solution, acidolysis process adopts 98 mass percent industrial concentrated sulfuric acid for acidity adjustment, the acidolysis time is 3 hours, the pH at the end of the reaction is 4.

(4) Copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration process as a supplementary solution of acidolysis solution. The copper recovery rate is 98.9%, the nickel recovery rate is 98.3%, and the precious metal recovery rate is 99.1%.

Embodiment 3

Follow the steps below to recover:

(1) Melting and blending: adding multi-metals obtained by pyrolysis of waste integrated circuit boards into a smelting furnace, and adding a covering agent for smelting and blending under 1200° C. with 1 hour to obtain an alloy solution; adopts carbon powder or coal powder as the covering agent, and the amount of covering agent added is 5% of the mass of multi-metal.

(2) Atomization: atomize the alloy solution obtained in step (1) to obtain atomized powder and atomized gas; the atomization water pressure is 10 MPa, the oxygen pressure is 1.2 MPa, and the nozzle aperture is 2 mm.

(3) Acidolysis and filtration: the atomized powder obtained in step (2) is immersed in an acidolysis solution for acidolysis, the acidolysis solution and acidolysis slag are obtained by filtration, and the acidolysis slag is preciously recovered to obtain rare and precious metals; during the acidolysis and filtration process, 200 kg/m$^3$ sulfuric acid is used as acidolysis solution, the solution-solid ratio is 10 L:1 kg, the atomization gas is stirred with a flow rate of 10 L/min per liter acidolysis solution, acidolysis process adopts 98 mass percent industrial concentrated sulfuric acid for acidity adjustment, the acidolysis time is 3 hours, the pH at the end of the reaction is 3.

(4) Copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration process as a supplementary solution of acidolysis solution.

The copper recovery rate is 99.1%, the nickel recovery rate is 99.3%, and the precious metal recovery rate is 98.8%.

Embodiment 4

Follow the steps below to recover:

(1) Melting and blending: adding multi-metals obtained by pyrolysis of waste integrated circuit boards into a smelting furnace, and adding a covering agent for smelting and blending under 1350° C. with 0.5 hour to obtain an alloy solution; adopts carbon powder or coal powder as the covering agent, and the amount of covering agent added is 15% of the mass of multi-metal.

(2) Atomization: atomize the alloy solution obtained in step (1) to obtain atomized powder and atomized gas; the atomization water pressure is 15 MPa, the oxygen pressure is 1 MPa, and the nozzle aperture is 3 mm.

(3) Acidolysis and filtration: the atomized powder obtained in step (2) is immersed in an acidolysis solution for acidolysis, the acidolysis solution and acidolysis slag are obtained by filtration, and the acidolysis slag is preciously recovered to obtain rare and precious metals; during the acidolysis and filtration process, 150 kg/m$^3$ sulfuric acid is used as acidolysis solution, the solution-solid ratio is 15 L:1 kg, the atomization gas is stirred with a flow rate of 20 L/min per liter acidolysis solution, acidolysis process adopts 98 mass percent industrial concentrated sulfuric acid for acidity adjustment, the acidolysis time is 1 hour, the pH at the end of the reaction is 4.

(4) Copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration process as a supplementary solution of acidolysis solution.

The copper recovery rate is 98.7%, the nickel recovery rate is 99.1%, and the precious metal recovery rate is 99.1%.

Embodiment 5

Follow the steps below to recover:

(1) Melting and blending: adding multi-metals obtained by pyrolysis of waste integrated circuit boards into a smelting furnace, and adding a covering agent for smelting and blending under 1250° C. with 0.5 hour to obtain an alloy solution; adopts carbon powder or coal powder as the covering agent, and the amount of covering agent added is 10% of the mass of multi-metal.

(2) Atomization: atomize the alloy solution obtained in step (1) to obtain atomized powder and atomized gas; the atomization water pressure is 12 MPa, the oxygen pressure is 1.1 MPa, and the nozzle aperture is 2.5 mm.

(3) Acidolysis and filtration: the atomized powder obtained in step (2) is immersed in an acidolysis solution for acidolysis, the acidolysis solution and acidolysis slag are obtained by filtration, and the acidolysis slag is preciously recovered to obtain rare and precious metals; during the acidolysis and filtration process, 180 kg/m$^3$ sulfuric acid is used as acidolysis solution, the solution-solid ratio is 12 L:1 kg, the atomization gas is stirred with a flow rate of 100 L/min per liter acidolysis solution, acidolysis process adopts 98 mass percent industrial concentrated sulfuric acid for acidity adjustment, the acidolysis time is 2 hours, the pH at the end of the reaction is 3.5.

(4) Copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration process as a supplementary solution of acidolysis solution.

The copper recovery rate is 99.0%, the nickel recovery rate is 98.5%, and the precious metal recovery rate is 98.3%.

Embodiment 6

Follow the steps below to recover:

(1) Melting and blending: adding multi-metals obtained by pyrolysis of waste integrated circuit boards into a smelting furnace, and adding a covering agent for smelting and blending under 1300° C. with 1 hour to obtain an alloy solution; adopts carbon powder or coal powder as the covering agent, and the amount of covering agent added is 8% of the mass of multi-metal.

(2) Atomization: atomize the alloy solution obtained in step (1) to obtain atomized powder and atomized gas; the atomization water pressure is 13 MPa, the oxygen pressure is 1 MPa, and the nozzle aperture is 2.8 mm.

(3) Acidolysis and filtration: the atomized powder obtained in step (2) is immersed in an acidolysis solution for acidolysis, the acidolysis solution and acidolysis slag are obtained by filtration, and the acidolysis slag is preciously recovered to obtain rare and precious metals; during the acidolysis and filtration process, 160 kg/m$^3$ sulfuric acid is used as acidolysis solution, the solution-solid ratio is 11 L:1 kg, the atomization gas is stirred with a flow rate of 200 L/min per liter acidolysis solution, acidolysis process adopts 98 mass percent industrial concentrated sulfuric acid for acidity adjustment, the acidolysis time is 1.5 hours, the pH at the end of the reaction is 3.6.

(4) Copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration process as a supplementary solution of acidolysis solution.

The copper recovery rate is 98.3%, the nickel recovery rate is 98.7%, and the precious metal recovery rate is 99.0%.

The invention claimed is:

1. A method for multi-metal products recovery from pyrolytic waste integrated circuit boards, comprising the following steps:

(1) melting and blending: adding multi-metals obtained by pyrolysis of waste integrated circuit boards into a smelting furnace, and adding a covering agent for smelting and blending under 1200-1350° C. for 0.5-1 hour to obtain an alloy solution, wherein the covering agent comprises one of carbon powder or coal powder, and an amount of covering agent added is 5-15% of the mass of multi-metals;

(2) atomization: atomize the alloy solution obtained in step (1) to obtain atomized powder and atomized gas;

(3) acidolysis and filtration: the atomized powder obtained in step (2) is immersed in an acidolysis solution for acidolysis reaction, the acidolysis solution and acidolysis slag are obtained by filtration, and the acidolysis slag is recovered to obtain rare and precious metals;

(4) copper extraction and back extraction: the acidolysis solution obtained in step (3) is subjected to copper extraction and back extraction to obtain copper sulfate and copper raffinate;

(5) nickel extraction and back extraction: copper raffinate obtained in step (4) is subjected to nickel extraction and back extraction to obtain nickel sulfate and nickel raffinate, and the nickel raffinate returns to the acidolysis and filtration step as a supplementary solution of the acidolysis solution, wherein during the atomization step, an atomization water pressure is 10-15 MPa, an oxygen pressure is 1-1.2 MPa, and a nozzle aperture is 2~3 mm, wherein during the acidolysis and filtration step, 150-200 $kg/m^3$ sulfuric acid is used as the acidolysis solution, the solution-solid ratio is 10 L:1 kg-15 L:1 kg, the atomization gas obtained in step (2) is stirred with a flow rate of 1-300 L/min per liter of the acidolysis solution, the acidolysis reaction uses 98 mass percent industrial concentrated sulfuric acid for acidity adjustment, a time of the acidolysis is 1-3 hours, and a pH at the end of the acidolysis reaction is 3-4.

* * * * *